United States Patent [19]

Shumway

[11] Patent Number: 4,545,267

[45] Date of Patent: Oct. 8, 1985

[54] COMBINATION GEAR RATCHET WRENCH APPARATUS

[76] Inventor: Warren R. Shumway, 806 E. Todd, Tempe, Ariz. 85283

[21] Appl. No.: 586,304

[22] Filed: Mar. 5, 1984

[51] Int. Cl.[4] ..... B25B 17/00

[52] U.S. Cl. ..... 81/57.29; 81/58.2; 81/63

[58] Field of Search ..... 81/58.1, 62, 63, 57.29

[56] References Cited

U.S. PATENT DOCUMENTS

| | | | |
|---|---|---|---|
| 3,972,252 | 8/1976 | Hunter | 81/57.29 |
| 4,086,829 | 5/1978 | Hudgins | 81/57.29 X |
| 4,137,801 | 2/1979 | Imperio | 81/58.1 |
| 4,406,183 | 9/1983 | Wix | 81/57.29 |
| 4,406,184 | 9/1983 | Cockman | 81/57.29 |
| 4,448,095 | 5/1984 | Blodgett et al. | 81/58.1 X |

FOREIGN PATENT DOCUMENTS

| | | | |
|---|---|---|---|
| 10335 | 5/1969 | Japan | 81/57.29 |

*Primary Examiner*—James G. Smith

*Attorney, Agent, or Firm*—H. Gordon Shields

[57] ABSTRACT

Ratchet wrench apparatus includes a beveled gear arrangement for allowing the ratchet apparatus to operate through rotary movement of a portion of the handle as well as by a standard oscillating handle motion. Included is a neutral position for disengaging the beveled gearing to allow oscillation of the handle without feedback rotation.

5 Claims, 4 Drawing Figures

FIG. 1
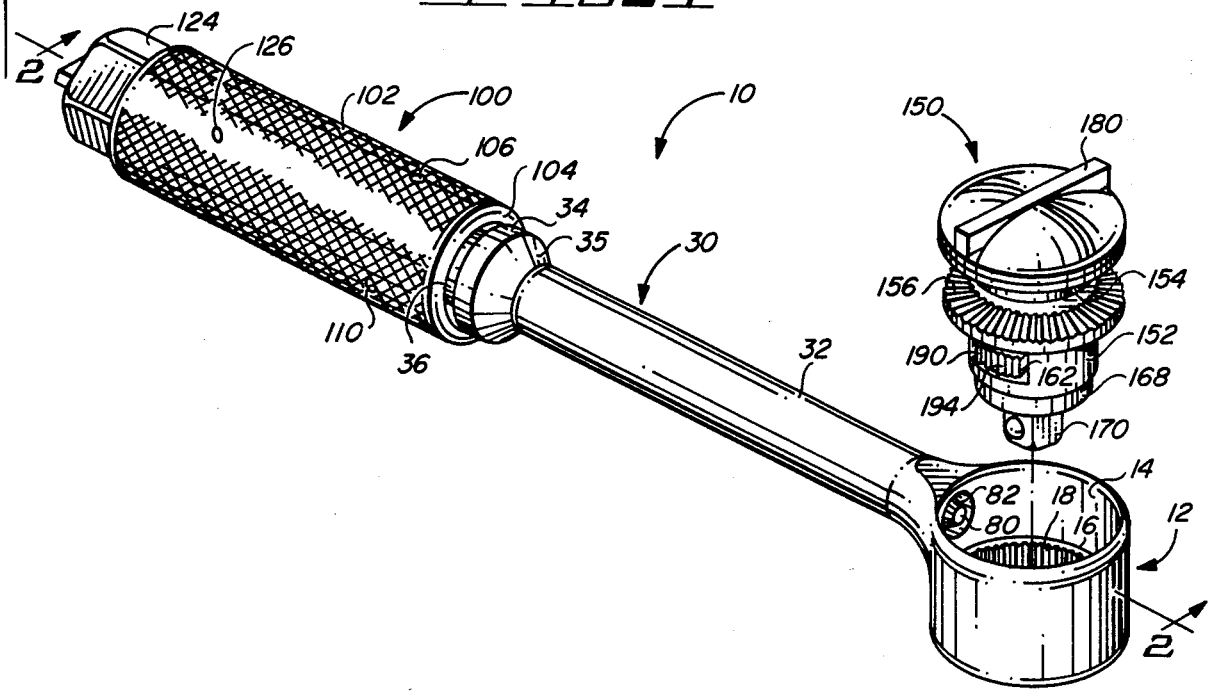
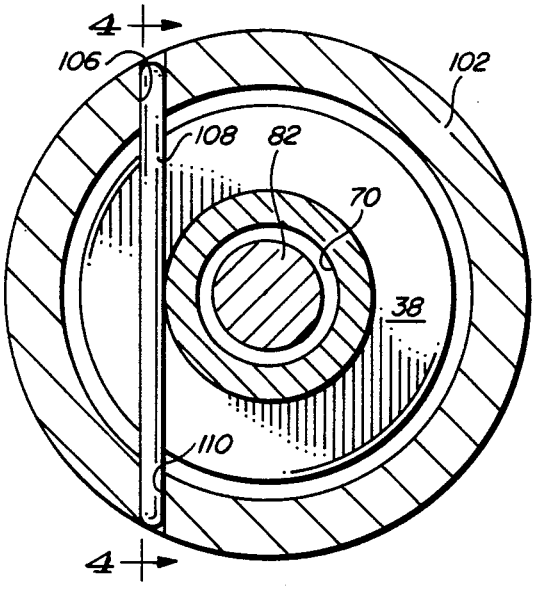
FIG. 3
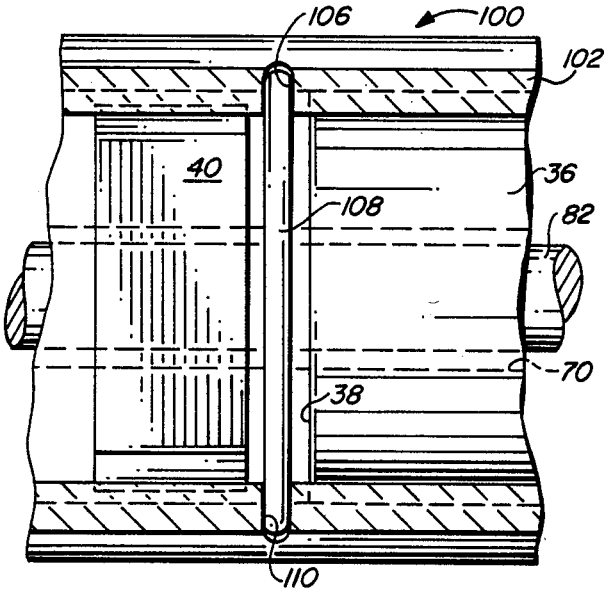
FIG. 4

COMBINATION GEAR RATCHET WRENCH APPARATUS

BACKGROUND OF THE INVENTION

1. Field of the Invention

This invention relates to ratchet wrenches and, more particularly, to a combination ratchet wrench operable by oscillating motion of the handle and by rotary motion of the handle.

2. Description of the Prior Art

An early wrench utilizing a gear system is shown in U.S. Pat. No. 541,494. The jaws of the wrench are rotated in one plane by rotation of the handle of the wrench in an opposite plane by a gear connection between the handle and the jaws.

U.S. Pat. No. 877,541 discloses another type of wrench apparatus in which rotation of a handle results in rotation of wrench jaws through a beveled gearing arrangement.

U.S. Pat. No. 1,301,472 discloses another type of beveled gear arrangement for rotating a socket by rotation of the handle.

U.S. Pat. No. 1,416,271 discloses another socket wrench utilizing a beveled gear arrangement for rotating a socket by rotation of a portion of a handle.

U.S. Pat. No. 2,090,964 also discloses a geared wrench apparatus with a rotating crank at the end of the wrench handle for rotating the socket. The socket may also be rotated by movement of the handle by locking the rotating shaft and the handle together.

A ratchet wrench is disclosed in U.S. Pat. No. 2,206,082 in which a portion of a handle rotates and, through a beveled gear arrangement, causes rotation of the socket head portion of the wrench by rotation of a portion of the handle. The handle also includes a socket for rotating the handle to rotate the socket head portion of the wrench.

U.S. Pat. No. 2,594,669 discloses yet another type of socket wrench in which a socket head may be rotated by rotation of the handle of the wrench through a beveled gear arrangement. The wrench apparatus of the '669 patent also includes a ratchet arrangement for a standard ratchet operation of the wrench. A socket at the end of the handle helps to rotate the handle when the alternate mode of operation is desired.

U.S. Pat. No. 2,906,153 further discloses another type of dual purpose ratchet wrench in which a typical ratchet head is supplemented by a beveled gear arrangement for rotating the socket head by rotation of a portion of the handle.

U.S. Pat. No. 3,707,893 discloses another type of dual purpose ratchet wrench in which the typical ratchet operation is supplemented by a beveled gear arrangement for rotating the ratchet head by rotation of a portion of the handle. The beveled gear arrangement is locked into and out of operation by means of a D-ring on the end of the rotatable shaft which allows the shaft to be moved axially in the wrench handle. A spring biases a gear on the end of the shaft, remote from the D-ring, against a mating beveled gear of the ratchet head. By pulling the D-ring, the shaft is moved out of engagement with the beveled gears and the shaft may be rotated ninety degrees to move a pin into a detent which holds the shaft out of engagement.

U.S. Pat. No. 3,733,936 discloses a wrench having both the ratchet drive and a high speed gear drive in which rotation of a portion of the handle causes rotation of the wrench socket head through a beveled gear arrangement. The beveled gears remain in mating relationship, and the change from one mode of operation to another mode of operation is accomplished through a pin arrangement within the socket head.

U.S. Pat. No. 3,972,252 discloses another type of ratchet wrench utilizing beveled gears for rotating the socket head by rotation of a shaft which extends through the handle. The shaft extends outwardly beyond the handle for engagement by another tool, if desired, to help rotate the shaft. The shaft includes a cross pin which forms a "tee" handle to assist in turning the shaft. Outwardly beyond the "tee" portion of the handle is a square tubing portion to which may be applied a wrench or which may be received by a socket, as desired. Rotation of either the handle or the head results in rotation of the opposite end, thus providing a double-ended drive system.

U.S. Pat. No. 4,086,829 discloses still another type of ratchet wrench utilizing a beveled gearing system for rotating the socket head by rotation of a portion of the handle. The rotating portion of the handle may be selectively engaged with a shaft connected to the beveling gears. When the rotating part of the handle is not engaged to the shaft, the shaft, which always includes a beveled gearing engagement, rotates as the gearing rotates by oscillating movement of the handle when the wrench is operated in the typical ratchet mode.

U.S. Pat. No. 4,240,310 discloses yet another type of ratchet wrench including a beveled gear system for rotating the ratchet head in response to rotation of a handle. An intermediate gear element is disposed between the ratchet gear and a rotating shaft to transmit rotary motion of the shaft to the ratchet gear head. Disengagement is effected by removing the intermediate gear out of mutual engagement.

U.S. Pat. No. 4,242,931 discloses still another type of ratchet gear apparatus in which a beveled gear arrangement is utilized to rotate a socket head of a wrench. In the '931 patent, a separate shaft, parallel to the primary handle shaft, is used. In the previously discussed embodiments, the primary handle is generally hollow, with the beveled gear arrangement including a shaft extending through the handle. In the '931 patent, the two handle portions are separate and parallel, one being disposed on top of, and alongside, the other shaft.

SUMMARY OF THE INVENTION

The invention described and claimed herein comprises a ratchet wrench including a beveled gear arrangement in which a portion of the handle of the wrench is rotatable to cause, through the beveled gear arrangement, rotation of the ratchet head. The rotation of the handle portion is selectively engaged and disengaged so that oscillation of the handle in the typical ratchet mode does not also result in rotation of the shaft and thus of the handle portion.

Among the objects of the present invention are the following:

To provide new and useful ratchet wrench apparatus;

To provide new and useful wrench apparatus having a ratchet oscillating mode and a handle rotating mode for rotating a socket head;

To provide new and useful dual acting ratchet wrench apparatus;

To provide new and useful ratchet wrench apparatus in which the mode of operation is selectable to operate either by oscillation of the wrench handle or by operation of the wrench handle; and To provide new and useful ratchet wrench apparatus selectively operable to move a socket head in either direction by oscillation of the handle or by rotation of a portion of the handle.

BRIEF DESCRIPTION OF THE DRAWING

FIG. 1 is a perspective view of the apparatus of the present invention with a portion of the apparatus separated therefrom.

FIG. 3 is a view in partial section taken generally along line 3—3 of FIG. 2.

FIG. 4 is a view in partial section taken generally along line 4—4 of FIG. 3.

DESCRIPTION OF THE PREFERRED EMBODIMENT

Figure 2:
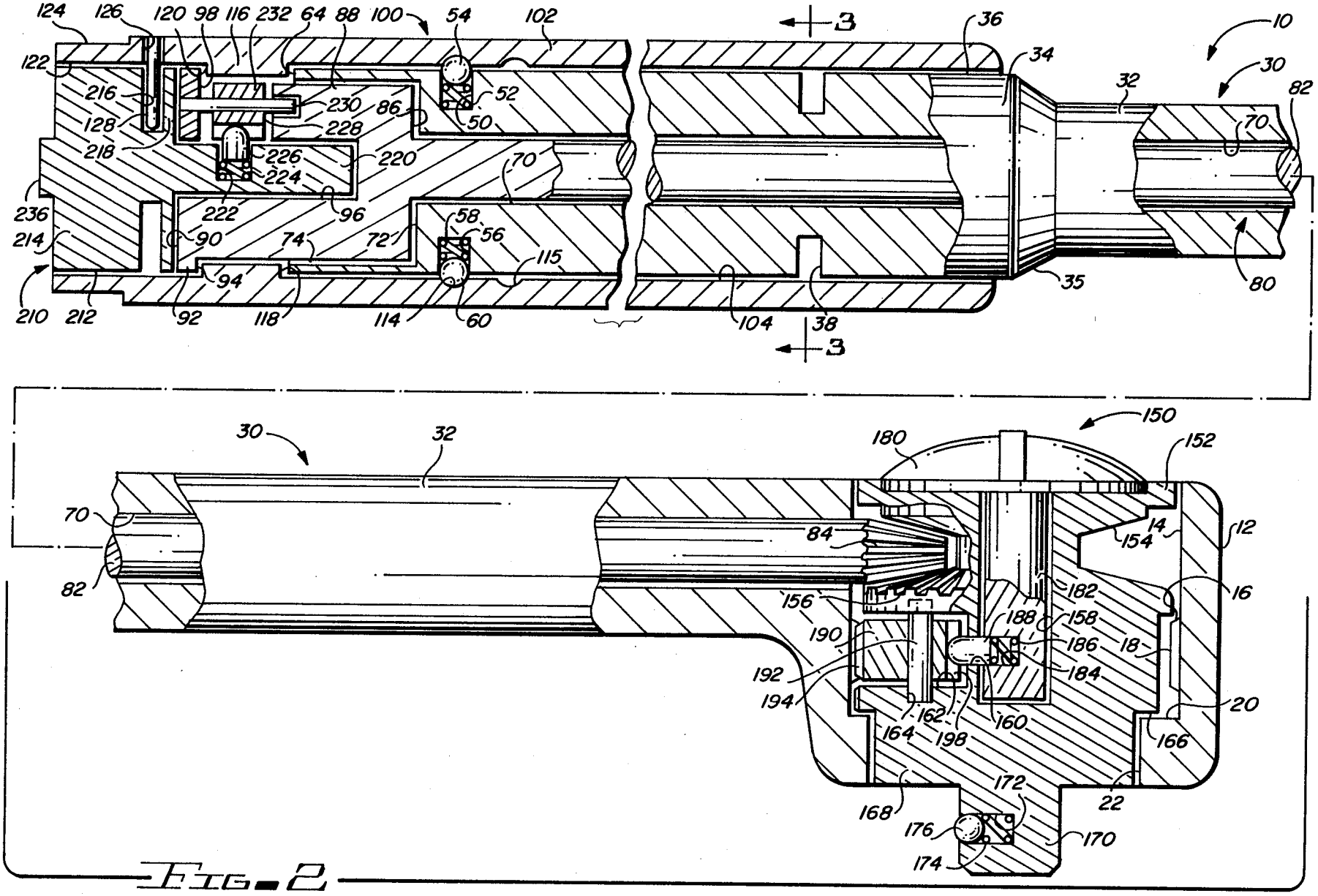
FIG. 2 is a view in partial section of the apparatus of FIG. 1, assembled, taken generally along line 2—2 of FIG. 1.

FIG. 1 is a perspective view of double ratchet apparatus 10. The ratchet apparatus 10 includes a cylindrical head portion 12, a handle portion 30 secured to the head portion 12, and two ratchet elements. A front ratchet drive 150 is shown in FIG. 1 spaced apart from the head 12. The head 12 defines a housing for the front ratchet drive 150.

FIG. 2 is a view in partial section of the ratchet apparatus 10 of FIG. 1, taken generally along line 2—2 of FIG. 1. The ratchet apparatus 10 includes the front ratchet drive 150 shown in FIG. 2 as disposed within the head 12, and a rear ratchet drive 210 shown in FIG. 2, as disposed within a sleeve 100. The sleeve 100 is in turn disposed about the rear portion of the handle 30. The sleeve 100 is also shown in FIG. 1. For the following discussion of the ratchet apparatus 10, reference will be made to both FIGS. 1 and 2.

The head 12 comprises a generally cylindrical element secured to the front portion of the handle 30. Within the head 12 is a relatively smooth upper bore and an intermediate bore 18. The intermediate bore 18 includes internal gear teeth which define a fixed ring gear which cooperates with the ratchet head 150. Below the intermediate bore 18, and best shown in FIG. 2, is a lower bore 22. The diameter of the lower bore 22 is less than the diameter of the intermediate bore 18. A radially extending shoulder 20 extends between the intermediate bore 18 and the lower bore 22.

The upper bore 14 is generally smooth, and its diameter is slightly greater than that of the intermediate bore 18. A radially extending shoulder 16 extends between the upper bore 14 and the intermediate or geared bore 18.

The handle 30 includes a front portion 32, an intermediate portion 34, and a rear portion 36. The intermediate portion 34 comprises a transition between the front portion 32 and the rear portion 36. The overall diameter of the intermediate handle portion 34 is greater than that of both the front portion 32 and the rear portion 36. The diameter of the front portion 32 is less than that of the rear portion 36. A sloping shoulder 35 extends outwardly and rearwardly from the front portion 32 to the intermediate portion 34.

On the rear handle portion 36 there is a circular channel or groove 38 which extends about the outer periphery of the rear handle portion 36. A flat 40, best shown in FIG. 4, extends rearwardly of the groove 38.

Spaced apart axially from the channel or groove 38 and the flat 40 is a pair of radially extending and diametrically aligned bores 50 and 56. The bores 50 and 56 extend radially inwardly from the outer periphery of the rear handle portion 36. Within the bore 50 is a compression spring 52 and a ball 54. Within the bore 56 is another compression spring 58 and a ball 60. The springs 52 and 58 are substantially identical, as are the balls 54 and 60.

The rear end of the handle 30 is defined by a shoulder 64. Within the handle 30 is a longitudinally extending bore 70. The bore 70 extends from the smooth upper bore 14 of the head 12 to the rear end or shoulder 64. Adjacent to the rear shoulder 64 is an enlarged portion 74 of the bore 70. The diameter of the enlarged portion 74 is substantially greater than the diameter of the rest of the bore 70. A shoulder 72 is disposed between the bores 70 and 74.

Disposed within the bore 70 is a drive shaft assembly 80. The drive shaft assembly 80 is generally of a circular configuration adapted to be disposed freely within the bores 70 and 74 without binding, etc. The assembly 80 includes a shaft 82.

The front end of the shaft 82 comprises a beveled gear portion 84. At the rear of the shaft 82 is an enlarged portion 88 which is disposed within the enlarged portion 74 of the bore 70. The enlarged portion 88 terminates in a radially outwardly extending flange 92, the outer diameter of which is slightly greater than that of the enlarged portion 88. The radially extending flange 92 includes a rear end 90, which is generally flat or planar, and a shoulder 94 which extends from the enlarged portion 88 to the flange 92.

Extending axially within the enlarged diameter portion 88 is a circular bore 96. The bore 96 receives elements associated with a rear ratchet drive assembly 210.

Adjacent to the bore 96 is a relieved portion or slot 98. The relieved portion or slot 98 is similar to the relieved portion or slot which is associated with the front ratchet drive 150.

Disposed over the rear portion of the handle 30, from the intermediate portion 34 to the rear end shoulder 64 of the handle, and disposed over part of the drive shaft assembly which is in turn disposed within the rear portion of the handle 30, is an outer sleeve 100. The outer sleeve 100 includes a cylindrical portion 102. Extending through the cylindrical portion 102 is an internal longitudinally extending bore 104.

Extending through the outer sleeve 100 is a pair of bores 106 and 110. A pin or set screw 108 extends through the bore 106, the slot 38, and the bore 110. The pin or set screw 108 is axially movable with the sleeve 100 relative to the handle 30 in the groove 38.

FIG. 3 is a view in partial section through the rear portion 36 of the handle 30 and the cylindrical portion 102 of the handle 100, taken generally along line 3—3 of FIG. 2. FIG. 4 is a view in partial section taken generally along line 4—4 of FIG. 3, showing details of the cooperating elements for moving the sleeve 100 and the drive shaft assembly 80 relative to the handle 30. For the following discussion, reference will primarily be made to FIGS. 3 and 4.

It will be noted, as best shown in FIG. 3, that the slots or bores 106 and 110, while aligned with each other, extend on a chord of the outer sleeve 102 and of the rear portion 36 of the handle 30. The bores or slots 106 and 110 are not diametrically extending, but rather are offset from the center of the cylinder 102 of the sleeve 100, the handle 36 and the shaft 82 of the drive shaft assembly 80.

The pin 108 is disposed within the aligned apertures 106 and 110, and, as shown in FIGS. 3 and 4, extends into the groove 38 of the rear portion 36 of the handle 30. The pin 108 is locked in place in the cylinder portion 102 of the sleeve 100 within the aligned apertures 106 and 110.

With the pin 108 disposed in the groove 38, the outer sleeve 100 is able to rotate within the groove 38 relative to the handle 30. Since the drive shaft assembly 80 is connected to the outer sleeve 100, as will be discussed in detail below, rotation of the outer sleeve 100 will result, ultimately, in rotation of the longitudinal drive shaft 82 of the drive shaft assembly 80. This in turn will result in rotation of the front ratchet drive 150, as will also be discussed in detail below.

To disengage the drive shaft 82 from the front ratchet drive assembly 150, there is a flat 40 on the rear portion 36 of the handle 30. The flat 40 communicates with and extends rearwardly from the groove 38. When the outer cylinder 102 of the sleeve 100 is rotated so that the pin 108 is aligned with the flat 40, the cylindrical portion 102 of the outer sleeve 100 may be moved rearwardly. The rearward motion or movement of the outer sleeve 100 may only occur when the pin 108 is aligned substantially parallel to the flat 40. The sleeve 100 then moves rearwardly with the pin 108 moving along the flat 40. The rearward movement of the sleeve 100 results in the rearward movement of the drive shaft assembly 80. This causes the disengagement of the longitudinally extending drive shaft 82 from the front ratchet drive 150.

With the drive shaft assembly 80 disengaged from the front ratchet drive 150, the ratchet apparatus 10 is usable in the "normal" or conventional ratchet mode in which oscillation of the handle 30 is used for ratcheting action.

It will be noted that, with the pin 108 disposed along the flat 40, the outer sleeve 100 is not rotatable relative to the handle 30. Rather, the outer sleeve 100 is then locked for joint movement with the handle 30.

Movement of the outer sleeve 100 forwardly, which moves the pin 108 along the flat 40 and into the groove 38, results in the engagement of the drive shaft 82 with the front ratchet drive assembly 150. Rotation of the outer sleeve 100, unless the rear ratchet drive assembly 210 is in its neutral position, will then result in rotation of the front ratchet drive assembly 150.

At the rear of the sleeve 100 is an internal groove 114 which receives the balls 54 and 60. A second internal groove 115 is spaced apart from the groove 114. The grooves 114 and 115 are parallel to each other on the internal periphery of the bore 104. The grooves 114 and 115 define lock grooves for locking the cylindrical portion 102 of the outer sleeve 100 relative to the handle 30. This will be discussed in more detail below.

Returning again to FIG. 2, the balls 54 and 60 are shown disposed in the internal groove 114. Rearward movement of the sleeve 100 will cause the balls 54 and 60 to be cammed into their bores 50 and 56, and against the compression springs 52 and 58, respectively. When the front internal groove 115 is aligned with the balls 54 and 60, the balls will move into the groove 115, locking the sleeve 100 relative to the handle 30, thus locking the outer sleeve 100 and the handle 30 in the "locked out" position in which the rear ratchet drive assembly 210 and the drive shaft assembly 80 is disengaged from the front ratchet drive assembly 150. This may only take place, of course, when the pin 108 is aligned with the flat 40, as discussed in the preceding paragraphs.

It will be noted that, due to the grooves 114 and 115, and the balls 54 and 60, a positive axial movement is required to move the outer sleeve 100 relative to the handle 30. The positive motion is required due to the locking feature of the balls 54 and 60 and their grooves 114 and 115 for movement of the outer sleeve 100 in both forward and rearward directions.

Rearwardly of the sleeve 100, and rearwardly of the internal groove 114, which extends into the bore 104, is a ring gear portion 116. The ring gear portion 116 includes a plurality of gear teeth having a minor diameter less than the diameter of the bore 104. On opposite ends of the ring gear portion 116 are shoulders 118 and 120. The shoulder 118 extends between the ring gear portion 116 and the bore 104, and the shoulder 120 extends between the ring gear 116 and a ring bore 122. The radially extending flange 92 of the drive shaft assembly 80 is disposed adjacent to the shoulder 120 in the bore 82.

At the rear of the sleeve 100 is a hex flat portion 124. The hex flats 124 are adapted to receive a wrench or a socket for purposes of turning the sleeve 100 and the ratchet drive assembly 80.

The front ratchet drive 150 includes a generally cylindrical block 152. The block 152 includes a circularly extending groove 154, the bottom or lower of which groove includes a beveled gear portion 156. In FIG. 2, the beveled gear 82 of the shaft 80 is shown engaging the beveled gear 156 of the block 152.

Extending axially within the center of the block 152 is a vertical or axially extending bore 158. Communicating with the bore 158 is a radially extending bore 160. The bore 160 extends from the vertically or axially extending bore 158 to a slot or relieved portion 162. The slot or relieved portion 162 comprises a relieved portion of the block 152 below the beveled gear portion 156. The relieved portion 162 comprises a relieved portion extending on a cord of the cylindrical block 152 outwardly.

Centrally located with respect to the slot or relieved portion 162, and extending in an axial direction, are a pair of aligned pin bores 164. The pin bores 164 extend upwardly and downwardly into the block 152 from the slot or relieved portion 162.

The block 152 includes a radially extending shoulder 166 which extends inwardly from the outer periphery of the block 152 to a lower cylindrical portion 168. As shown in FIG. 2, the shoulder 166 is disposed on the shoulder 20 of the head 12, and the lower cylindrical portion 168 extends through the lower bore 22 of the head 12.

Extending downwardly from the center of the block 152, and accordingly from the center of the lower cylindrical portion 168, is a square drive 170. The square drive 170 includes a radially extending bore 172 in which is disposed a compression spring 174 and a ball 176. The outer portion of the square drive 170 is appropriately paned over the ball 176 to prevent the ball 176 from leaving the bore 172. The spring 174 is a compression spring which provides an outward bias against the ball 176. The use of the bore, spring, and ball is well known and understood in the art. Its purpose is to help hold the square drive shank 170 into a mating square bore of a socket when the apparatus 10 is in use.

On the top of the block 152 is a ratchet actuator knob 180. The ratchet actuator knob 180 includes a shaft 182 which extends into the bore 158 of the block 152. The shaft 182, at its lower end, includes a radially extending bore 184. A compression spring 186 is disposed within the bore 184, and a pin or dog 188 is also disposed within the bore 184. The spring 186 is a compression spring which provides an outward bias to the pin or dog 188.

Disposed within the relieved portion 162 is an arcuately extending ratchet pawl 190. The pawl 190 includes a vertically extending pin 192. The pin 192 extends upwardly and downwardly into the aligned bores 164. The pin 192 comprises a pivot pin on which the pawl 190 pivots in response to movement of the actuator knob 180.

At the outer ends of the pawl 190 are ratchet teeth which engage the internal ring gear portion of the bore 18 of the head 12. In both FIGS. 1 and 2, only one portion of the teeth, a portion 194, is shown.

Centered at the rear of the pawl 190 is a slot 198. The pin or dog 188 is shown extending into the slot 198.

The ratchet actuator knob 180 includes three positions, a right position, a left position, and a neutral position. In one position, the teeth at one end of the pawl 190 engage the internally geared portion 18 of the head 12, and in the other position, the teeth at the opposite end of the pawl engage the geared portion 18 of the head 12. The third position of the actuator knob 180 comprises a neutral position, in which neither set of ratchet teeth of the pawl 190 engage the internal ring gear portion 18 of the head 12.

The operation of ratchet wrenches is well known and understood and accordingly will not be discussed in detail herein. With one set of ratchet teeth on the pawl 190 engaging the internal ring gear 18, the ratchet drive 150 is locked to the head 12 and the handle 30 in one direction, but released therefrom in the opposite direction. With the other ratchet teeth engaged, the handle and the head are then locked together for the opposite oscillating movement of the handle and released in the other direction. The direction of oscillating movement for locking and unlocking is accordingly accomplished by movement of the ratchet actuator knob 180 for movement of the pawl 190.

The rear ratchet drive assembly 210 includes the cylindrical block portion 212 which is disposed within the bore 122 of the sleeve 100. The block 212 includes a circumferentially extending groove 216. The groove 216 is aligned with a pair of aligned apertures 126 which extend through the outer sleeve 100 on a chord of the sleeve 100. A pin 128 extends through the aligned apertures 126 and is disposed within the groove 216 to lock the rear ratchet drive assembly 210 to the sleeve 100. The aligned apertures 126 are not diametrically extending, but rather extend across the outer sleeve 100 at an angle which comprises the chord of the circumference of the cylinder 102.

The groove 216 essentially divides the cylinder block 212 into two portions, a rear block portion 214 and a relatively short, axially speaking, front plate 218. The plate 218 is disposed against the rear end 90 of the drive shaft assembly.

Extending axially from the block 212, and also from the plate 218, is a centrally located square shaft or stem 220. The shaft or stem 220 extends into the square bore 96 of the enlarged diameter portion 88 of the drive shaft assembly 80. The shaft or stem 220 includes a radially extending bore 222. A compression spring 224 is disposed in the bore 222 to provide bias for a pin or dog 226 which is also disposed in the bore 222 and extends outwardly therefrom.

A pin or dog 226 is disposed against the rear portion of an arcuate pawl 228. The pawl 228 is disposed within the relieved portion or slot 98 of the enlarged diameter portion 88 of the drive assembly 80. The pawl 228 pivots on a pivot pin 230 which is also disposed within the enlarged rear portion 88 of the drive shaft assembly 80. The pawl 228 includes two sets of ratchet teeth. The ratchet teeth, including a portion 232, are disposed at the outer ends of the pawl 228.

The pawl 228 is similar to the pawl 190 of the front ratchet drive assembly 150. By a pivoting motion or movement of the cylinder block by means of a knob 236, the pin or dog 226 causes the pawl 228 to pivot. The pivoting of the pawl 228 engages and disengages the teeth at opposite ends of the pawl to determine the direction of rotation of the shaft assembly 80 in a drive configuration and the direction of the ratcheting action of the apparatus. The teeth of the pawl 228 engage the internal teeth or ring gear portion 116 of the outer sleeve 100. In addition to the "right" or "left" movement of the drive shaft assembly 80 by rotation of the outer sleeve 100 through the rear ratchet drive 210, the knob 236 may be used to position the pawl 228 in a neutral position. In the neutral position, the teeth of the pawl 228 are disengaged from the internal ring gear 116 of the handle 100. The handle 100 may then rotate freely, or "free wheel" without engagement of the drive shaft assembly 80.

The front ratchet drive assembly 150 determines the direction of rotation of a socket secured to the square drive element 170. The rear ratchet assembly 210, on the end of the handle 34 and at the end of the outer sleeve 100, determines the direction of rotation of the handle. The wrench apparatus 10 is thus double-acting and with a double stroke. By disengaging the rear ratchet assembly, the wrench apparatus 10 may be used as a common, ordinary ratchet apparatus, involving only the front ratchet drive 150.

The disengagement of the rear ratchet drive 210 may be accomplished by aligning the outer sleeve 100 so that the pin or set screw 108 is aligned with the axially extending flat 40 of the rear portion 36 of the handle 30. By then moving the sleeve 100 rearwardly, the drive shaft assembly 80 is moved rearwardly by the internal shoulder 120 of the cylinder 102 abutting the shoulder 94 of the drive shaft assembly 80, thereby moving the drive shaft assembly rearwardly with the outer sleeve 100. The beveled gear 84 of the shaft 82 disengages the beveled gear 156 of the front ratchet drive assembly 100. This comprises a neutral position which allows oscillation of the handle 30 without rotation of the outer sleeve 102 by feedback through the shaft 82.

As the sleeve 100 moves rearwardly, the balls 54 and 60 are cammed into the bores 50 and 56, respectively, and out of the groove 114, and against their respective springs 52 and 58 until the internal groove 115 is aligned with the bores and balls. The balls 54 and 60 then move outwardly into the groove 115 under the bias of their respective compression springs 52 and 58.

The axial distance between the grooves 114 and 115 is sufficient to provide for the disconnection between the bevel gear portion 84 of the drive shaft 82 and the mating bevel gear 156 of the front ratchet drive 150. With the shaft 82 disconnected from the front ratchet drive 150, the apparatus 10 functions as a "standard" or "normal" ratchet apparatus.

With the pin 108 disposed along the flat 40, the outer sleeve 100 is locked to the handle 30 and accordingly does not rotate. The length of the flat 40 determines the extent or length of the relative rearward movement of the sleeve 100 and the drive shaft assembly 80 relative to the handle 30 and the front ratchet drive 150.

When the outer sleeve 100 is moved forwardly, the reverse action takes place. The balls 54 and 60 are cammed out of the groove 115 and into their bores 50 and 56, respectively. When the groove 114 is aligned with the bores 54 and 60 and the bores 50 and 56, respectively, the springs 52 and 58 bias the balls outwardly onto the groove 114, locking the sleeve 100 in its forward position. At the same time, the pin 108 moves forwardly along the flat 40 and into the groove 38 of the rear portion 36 of the handle 30. The forward movement also moves the beveled gears 84 and 156 into a meshing engagement.

When the gears 84 and 156 are thus engaged, and the selector knob 236 is used to select either a "right" or a "left" drive, rotation of the sleeve 100, as by hand or manual rotation of the sleeve or by engagement of a wrench, or another socket, or the like, with the flats 124 of the sleeve 100, the rotation of the sleeve 100 results in rotation of the drive shaft assembly 80. The rotation of the drive assembly 80 in turn results in the rotation of the ratchet drive 150 through the gear 156, as discussed above.

If the pin or set screw 108 is disposed in the groove 38, and the rear ratchet selector knob 236 is placed in the neutral position, the normal or conventional ratcheting action of the wrench 10, utilizing only the front ratchet drive 150, will still result in rotation of the drive shaft assembly 80. However, with the rear ratchet assembly 210 in neutral, the rotary motion of the drive shaft assembly 80 will not result in a corresponding rotary motion of the outer sleeve 100.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted for specific environments and operative requirements without departing from those principles. The appended claims are intended to cover and embrace any and all such modifications, within the limits only of the true spirit and scope of the invention. This specification and the appended claims have been prepared in accordance with the applicable patent laws and the rules promulgated under the authority thereof.

What is claimed is:

1. Combination gear ratchet apparatus, comprising, in combination:

first ratchet head means, including
- a first bore and
- a first ring gear in the bore;

front ratchet drive means, including
- a cylindrical block disposed in the first bore,
- first actuator pawl means adapted to matingly engage the first ring gear in the first ratchet head means for controlling the direction of rotation of the front ratchet drive means,
- drive means extending out of the first ratchet head means for matingly engaging a socket to be rotated,
- a circular groove, and
- gear means in the circular groove;

handle means secured to the ratchet head means for rotating the front ratchet drive means in response to an oscillating movement of the handle means when the first actuator pawl means is matingly engaged with the first ring gear;

a first bore in the handle means communicating with the first bore in the ratchet head means;

shaft means extending through the bore in the handle means, including
- a bevel gear adapted to matingly engage the gear means of the front ratchet drive means to rotate the front ratchet drive means when the shaft means is rotated, and
- second pawl means; and sleeve means disposed about the handle means remote from the ratchet head means, and movable longitudinally on the handle means, and including
- a second bore for receiving a portion of the handle means and a portion of the shaft means,
- a second ring gear in the second bore and adapted to matingly engage the second pawl means for rotating the shaft means in response to rotation of the sleeve means,
- wrench flats adapted to be secured to a wrench for rotating the sleeve means and the shaft means to rotate the front ratchet drive means when the gear means and the bevel gear of the shaft means are engaged,
- means for connecting the sleeve means and the shaft means together for joint axial movement relative to the handle means and the front ratchet drive means to matingly engage and disengage the bevel gear of the shaft means and the first ring gear, and
- means for securing together the handle means and the sleeve means to prevent relative rotation when the bevel gear of the shaft means is disengaged from the gear means.

2. The apparatus of claim 1 in which the means for connecting the sleeve means and the shaft means for joint axial movement includes a first circumferential groove on the shaft means and a first pin secured to the sleeve means and extending into the first circumferential groove.

3. The apparatus of claim 1 in which the handle means and the sleeve means further include means for locking the handle means and the sleeve means in a first axial position relative to each other for engaging the bevel gear of the shaft means and the gear means of the front ratchet drive means and in a second axial position relative to each other for disengaging the bevel gear and the gear means.

4. The apparatus of claim 3 in which the means for locking the handle means and the sleeve means includes
- a third bore in the handle means,
- a ball disposed in the third bore,
- a compression spring disposed in the third bore for biasing the ball out of the third bore,
- a second circumferential groove in the second bore for receiving the ball to lock the sleeve means and the handle means in the first axial position, and
- a third circumferential groove in the second bore spaced apart from the second circumferential groove for receiving the ball to lock the sleeve means and the handle means in the second axial position.

5. The apparatus of claim 1 in which the means for securing together the handle means and the sleeve means to prevent relative rotation includes a fourth circumferential groove on the handle means, a flat on the handle means disposed adjacent to and communicating with the fourth circumferential groove, and a second pin secured to the sleeve means and disposed in the fourth circumferential groove when the bevel gear of the shaft means is engaged with the gear means to allow relative rotation between the sleeve means and the handle means, and disposed against the flat when the bevel gear is disengaged from the gear means to prevent relative rotation between the sleeve means and the handle means.

* * * * *